United States Patent [19]

Colley et al.

[11] Patent Number: 4,903,677

[45] Date of Patent: Feb. 27, 1990

[54] POWER SPRING BOW

[76] Inventors: David E. Colley, 1715 Ozora Rd., Loganville, Ga. 30249; Donald G. Fain, 365 Jordan Dr., Tucker, Ga. 30084; Frederick R. Arnett, 1609 Carter Rd., Decatur, Ga. 30032

[21] Appl. No.: 266,066

[22] Filed: Nov. 2, 1988

[51] Int. Cl.[4] ..... F41B 5/00

[52] U.S. Cl. ..... 124/23 R; 124/DIG. 1

[58] Field of Search ..... 124/DIG. 1, 23 R, 25

[56] References Cited

U.S. PATENT DOCUMENTS

| | | | |
|---|---|---|---|
| 428,912 | 5/1890 | Holmes | 124/DIG. 1 |
| 965,361 | 7/1910 | Barnes . | |
| 3,515,113 | 6/1970 | Lawrence | 124/27 |
| 3,874,359 | 4/1975 | Cesin | 124/16 |
| 3,989,026 | 11/1976 | Nishioka | 124/DIG. 1 |
| 3,993,039 | 11/1976 | Groves et al. | 124/23 R |
| 4,041,927 | 8/1977 | Van House | 124/DIG. 1 |
| 4,078,537 | 3/1978 | Carella | 124/DIG. 1 |
| 4,183,345 | 1/1980 | Caldwell | 124/24 R |
| 4,227,509 | 10/1980 | Jones | 124/23 R |
| 4,287,867 | 9/1981 | Islas | 124/24 R |
| 4,338,909 | 7/1982 | Plummer | 124/16 |
| 4,388,914 | 6/1983 | Cesin | 124/27 |
| 4,457,288 | 7/1984 | Ricord | 124/23 R |
| 4,458,657 | 7/1984 | Stockmar | 124/17 |
| 4,646,708 | 3/1987 | Imes | 124/24 R |
| 4,651,707 | 3/1987 | Bozek | 124/17 |
| 4,688,539 | 8/1987 | Lawrence | 124/27 |
| 4,722,317 | 2/1988 | Hartwig | 124/23 R |
| 4,724,820 | 2/1988 | Chattin | 124/23 R |
| 4,756,295 | 7/1988 | Guzzetta | 124/DIG. 1 |

*Primary Examiner*—Randolph A. Reese
*Assistant Examiner*—Anthony Knight
*Attorney, Agent, or Firm*—Kimmel, Crowell & Weaver

[57] ABSTRACT

An archery bow design in which at least one flat wound power spring is mounted on a frame and is connected through an eccentric wheel or cam and a pulley system to a bow string so that the action of drawing back the bow string causes the coil spring to be wound up, storing energy. The eccentric wheel or cam and the pulley system provide a mechanical advantage whereby a relatively small force is required to draw the bow and wind up the power spring, and a relatively higher recoil velocity is obtained when the string is released.

20 Claims, 12 Drawing Sheets

POWER SPRING BOW

FIELD OF THE INVENTION

This invention relates in general to devices for propelling an object, and more particularly, to the art of archery, especially bows.

DESCRIPTION OF THE PRIOR ART

The art of archery is nearly as old as the use of tools by man. In its present state, archery is used primarily in recreational target shooting, competitive target shooting, and hunting.

Early archery bows consisted essentially of an elongate piece of wood having a central hand grip portion with resilient, spring-like limbs projecting from opposite ends thereof and a bow string stretched tightly between the outer ends of the limbs. This basic structure has been modified to include recurve or reverse curve bows, and compound bows utilizing a series of levers and cams to multiply the propelling force and/or provide a let-off of the force required to draw and hold the bow in a fully drawn position preparatory to release of an arrow. Other prior art efforts to improve the accuracy and range of archery equipment have included cross-bows, which incorporate a rifle-like stock having spring arms at a forward end and a trigger mechanism for holding and releasing the bow string.

Included among those features most desirable in an archery bow are: compact design; light weight; high release energy with small draw force, i.e., let-off bows; accuracy; silence and efficiency in operation; range; and craftsmanship, simplicity and economy in construction.

Examples of some prior art archery bows and related devices are described in the following U.S. Pat. Nos.: 3,515,113, 3,874,359, 3,989,026, 3,993,039, 4,018,205, 4,041,927, 4,183,345, 4,227,509, 4,287,867, 4,338,909, 4,388,914, 4,457,288, 4,458,657, 4,646,708, 4,651,707, 4,688,539, 4,722,317, 4,724,820 and 965,361. Some of these patents describe cross-bows and others describe sling shots. The remaining patents disclose various constructions of more or less conventional bow technology, i.e., bows utilizing spring-like limbs projecting from opposite ends of a central hand grip portion, and including compound bows or bows with levers, cables and springs intended to increase the force or energy of the bow and/or reduce the amount of force required to draw the bow, i.e., let-off. Some of these bows are substantially complex and expensive in construction, while others are relatively heavy and cumbersome to carry and operate. Still others would have low reliability because of the complexity of construction and use of relatively fragile multiple strings, etc.

SUMMARY OF THE INVENTION

Accordingly, it is an object of the present invention to provide an archery bow which is compact and lightweight in design.

Another object is to provide an archery bow which has a high recoil energy or thrust and which is designed to provide a reduction in the force required to draw the bow.

A further object of the invention is to provide an archery bow which is distinct in appearance and operation.

A still further object of the invention is to provide an archery bow in which a flat wound power spring is used as the energy storing medium as opposed to limbs, enabling the remaining components of the bow to be of lightweight construction.

Yet another object of the invention is to provide an archery bow employing multiple mechanical advantages in conjunction with a unique spring design, enabling a wide range of performance characteristics to be obtained.

The foregoing and other objects and advantages of the invention are achieved by a novel bow design in which at least one flat wound power spring is mounted on a frame and is connected through an eccentric wheel or cam and a pulley system to a bow string so that the action of drawing back the bow string causes the coil spring to be wound up, storing energy. The eccentric wheel or cam and the pulley system provide a mechanical advantage whereby a relatively small force is required to draw the bow and wind up the power spring, and a relatively higher recoil velocity is obtained when the string is released.

BRIEF DESCRIPTION OF THE DRAWINGS

The objects and advantages set forth above, as well as other objects and advantages of the invention will become apparent from the following detailed description and claims when considered in conjunction with the accompanying drawings, wherein like reference characters designate like parts throughout the several views, and wherein:

DETAILED DESCRIPTION OF THE PREFERRED EMBODIMENTS

Figure 8:
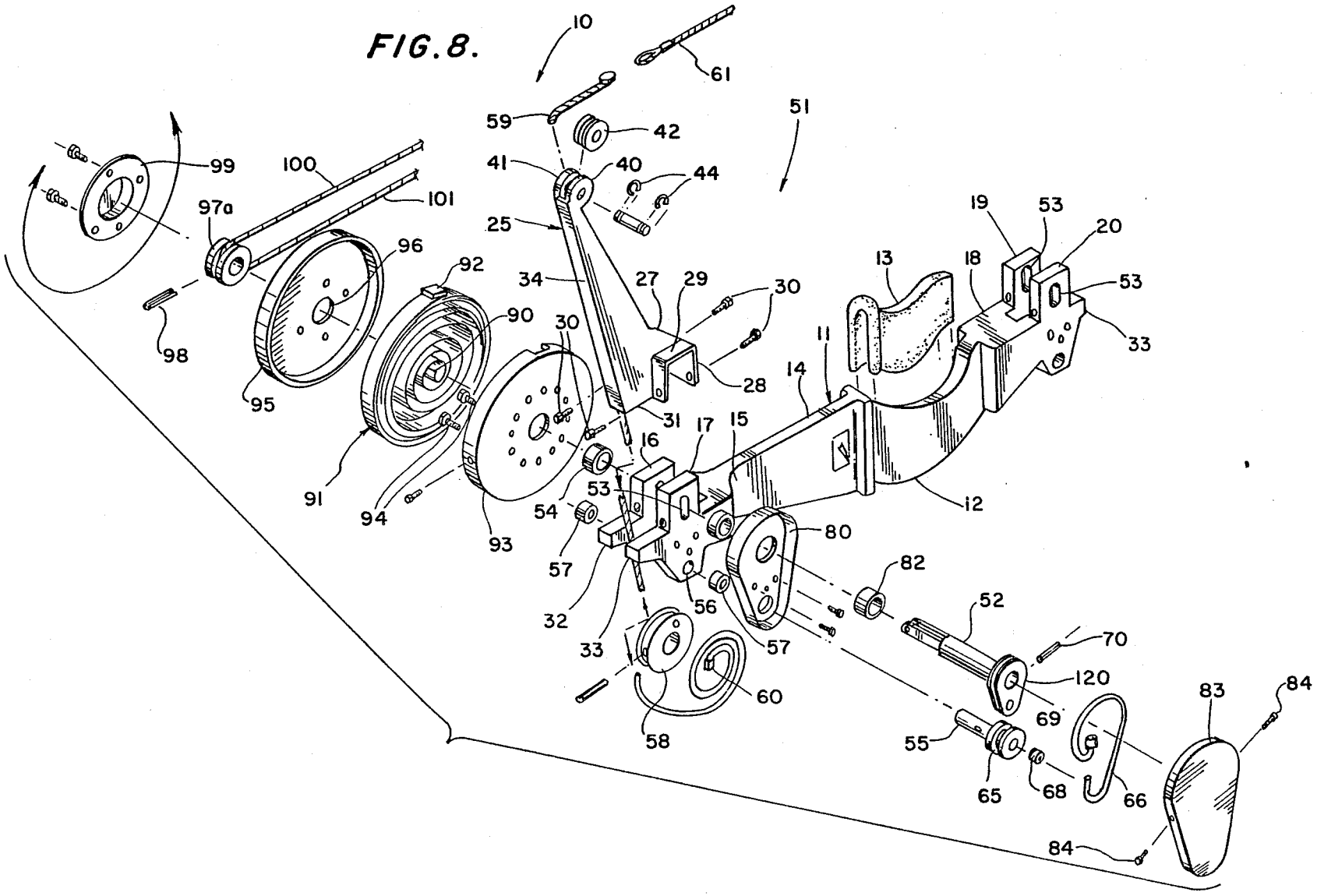
FIG. 8 is an exploded perspective view of the frame of the bow of the invention and one of the power spring recoil assemblies and arms of a modified form of the bow.

Referring more particularly to the drawings, a first form of archery bow in accordance with the invention is indicated generally at 10 in FIGS. 1–7. The bow comprises a frame 11 (see also FIG. 8) having a generally centrally disposed hand grip portion 12, to which a contoured grip or pad or the like 13 may be applied. The frame includes a first, upper end portion 14 terminating in its outer end in a thickened section 15 which is bifurcated to define two spaced apart mounting blocks 16 and 17. A second, lower end portion 18 extends from the other end of the hand grip portion, and as seen best in FIG. 8 is much shorter than the upper arm portion 14. Moreover, the lower end portion is shaped substantially identically to the thickened and bifurcated end 15 on the other end of the frame, and includes a pair of spaced apart mounting blocks 19 and 20.

A pair of fixed arms 25 and 26 of substantially identical construction are secured on the opposite ends of the frame 11. As seen in FIGS. 1, 2, 5 and 8, for example, each arm is essentially channel shaped in transverse cross-section and includes a relatively wider base portion 27 with a U-shaped mounting bracket 28 secured in a cut-out edge 29 thereof. The bracket 28, and thus the respective arm 26 and 27, are secured to the mounting blocks by means of threaded fasteners 30 extended through the bracket and into the mounting blocks. When thus secured, the base 31 of each arm lies against and is braced by the extended ends 32 and 33 of the mounting blocks and the hollow spine or back 34 lines up with the space between the extensions.

The outer end of each arm is shaped with spaced, contoured flanges 40 and 41, and an idler pulley 42 is supported therebetween by a pin 43. The pin and pulley may be retained in place by spring clips 44 or other suitable means, as desired.

Recoil assemblies 50 and 51 are mounted to the opposite ends of the frame, at the junctions of the fixed arms 25 and 26 with the frame 11. Each recoil assembly comprises a driven shaft 52 rotatably extended through aligned openings 53 in the mounting blocks 16, 17 and 19, 20, respectively. The shaft may be supported in bushings 54, if desired. Similarly, a drive shaft 55 is rotatably received in openings 56, and may be supported in bushings 57, if desired. A drive wheel or pulley 58 is pinned to the drive shaft 55 in the space between the mounting blocks 16, 17 and 19, 20, respectively, and a cable 59 is secured at one end 60 to the drive wheel. As seen best in FIG. 8, the cable 59 extends upwardly through the respective arm 25 and 26, and is disposed over the idler pulley 42. The cables 59 at opposite ends of the bow are attached to opposite ends of a bow string 61 stretched between the outer ends of the arms. Thus, when the bow string is pulled rearwardly, or to the right as viewed in FIG. 1, the cable 59 is pulled outwardly, unwinding from the wheel 58 and causing the wheel 58 and shaft 55 to rotate. It should be noted that the drive wheel thus serves as a take-up or storage spool to store the cable, whereby the bow string may be pulled rearwardly with a sufficient amount of draw or deflection to achieve the desired draw length. A typical, average draw length, for instance, is about twenty-eight inches, and as shown in the drawings (FIGS. 8 and 9, for example), the cable may be wound onto the spool 58 at least approximately one revolution. The size of the take-up or storage spool determines the amount of draw length by functioning to store more or less cable in the relaxed or at rest position of the bow.

A drive sprocket 65 is fixed on one end of the drive shaft 55 and is connected by a torque cable 66 to an eccentric wheel 67 fixed on one end of the driven shaft 52. As seen best in FIGS. 1 and 8, one end of the torque cable 66 is fixed to the drive sprocket 65 by a set screw 68 and the other end is fixed to the eccentric wheel 67 by a head member 69. The eccentric wheel is secured on the shaft 52 by a pin 70.

Figure 1:
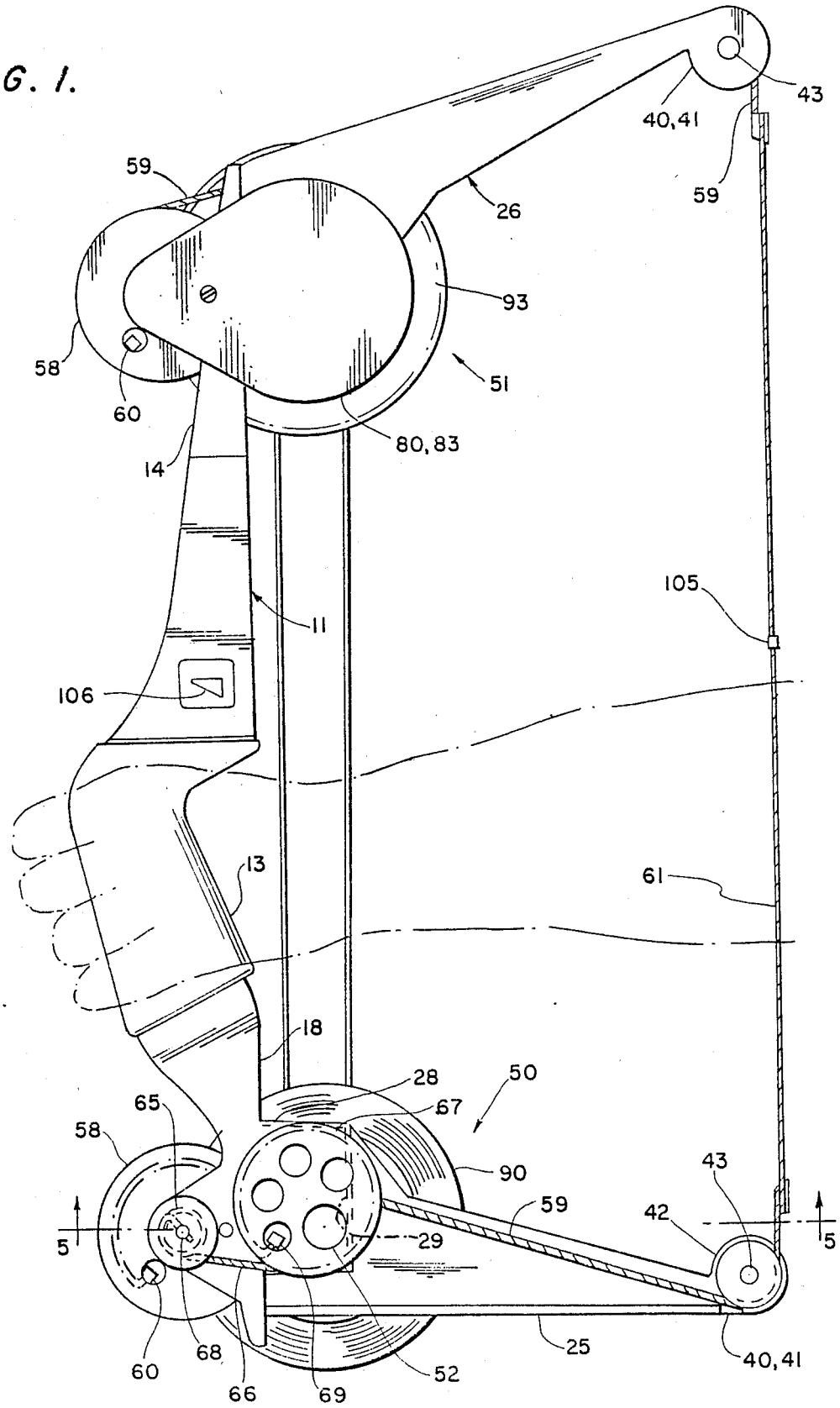
FIG. 1 is a left side view in elevation, with portions cut away or removed, showing a first form of the bow of the invention in an at-rest condition.
Figure 2:
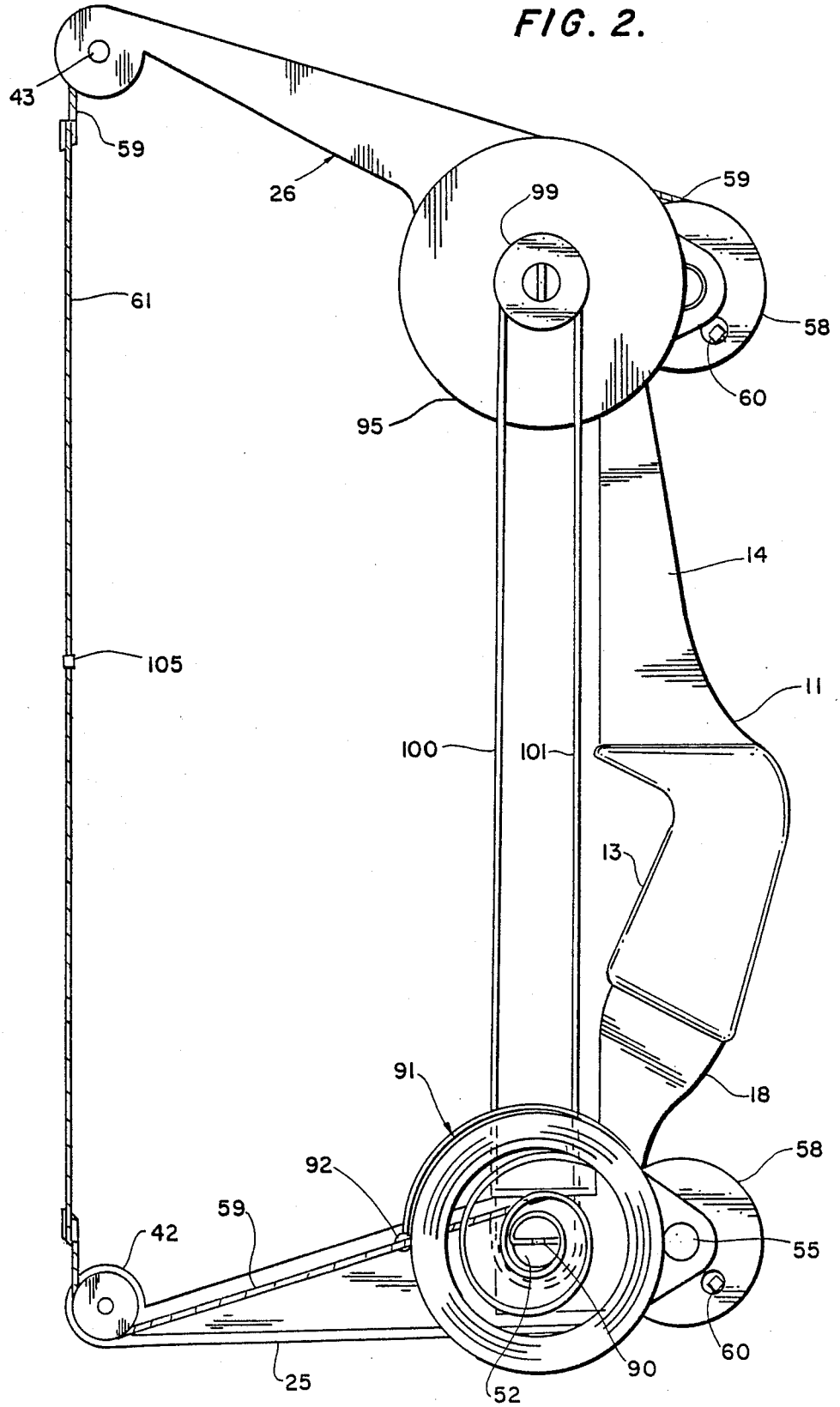
FIG. 2 is a right side view in elevation, with portions cut away or removed, of the bow of FIG. 1.
Figure 3:
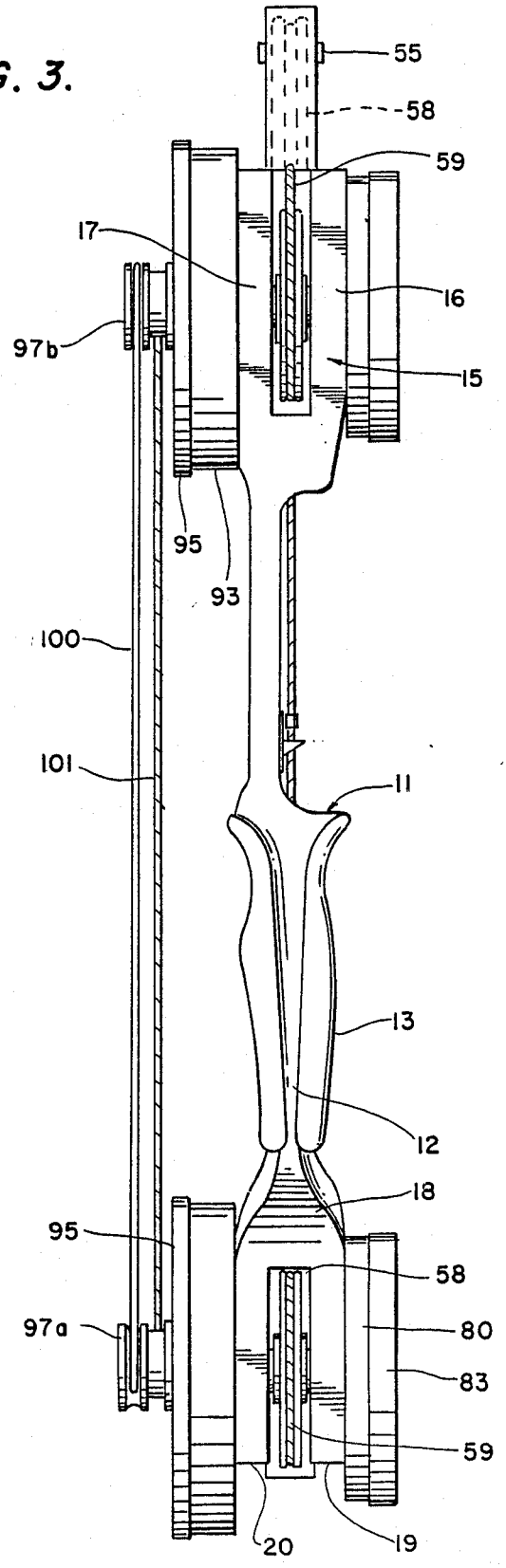
FIG. 3 is a front view in elevation of the bow of FIG. 1.
Figure 6:
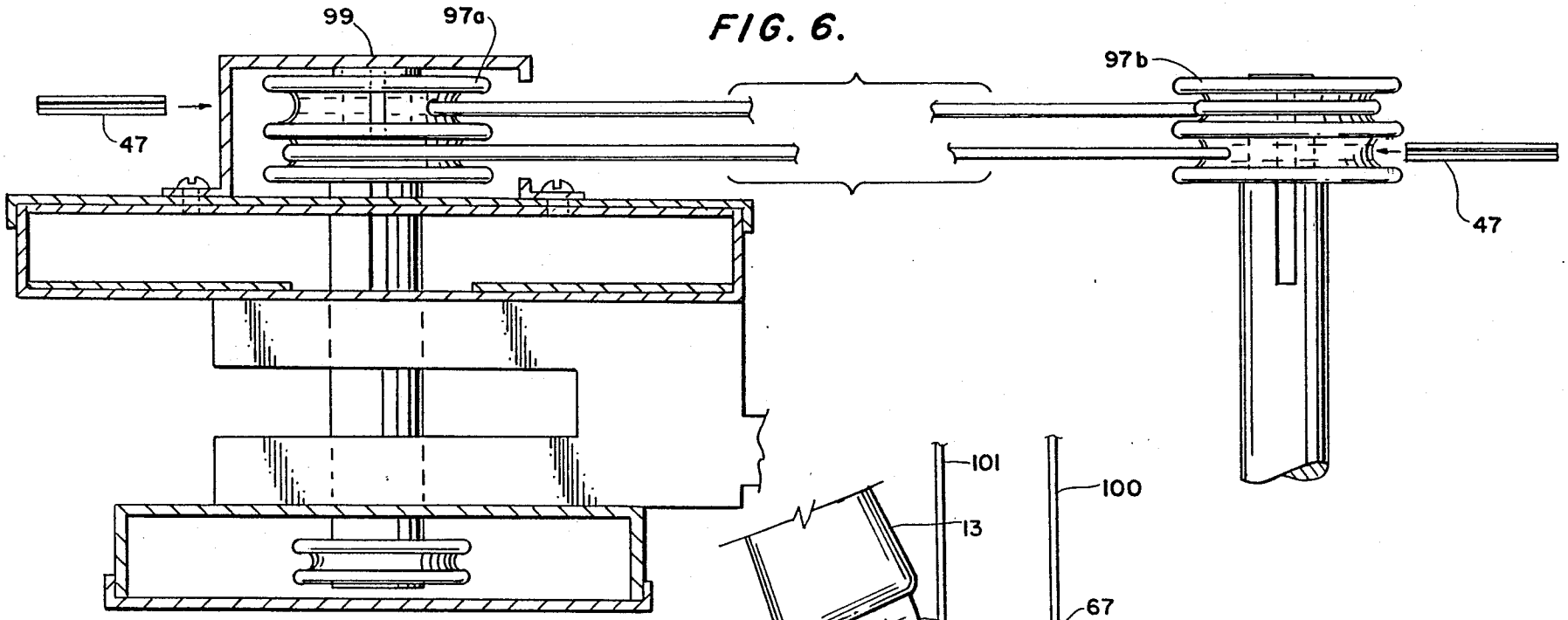
FIG. 6 is a somewhat schematic, fragmentary view showing the relationships of the synchronizing wheels and cable assemblies for transmitting torque and motion from one recoil assembly to the other.
Figure 4:
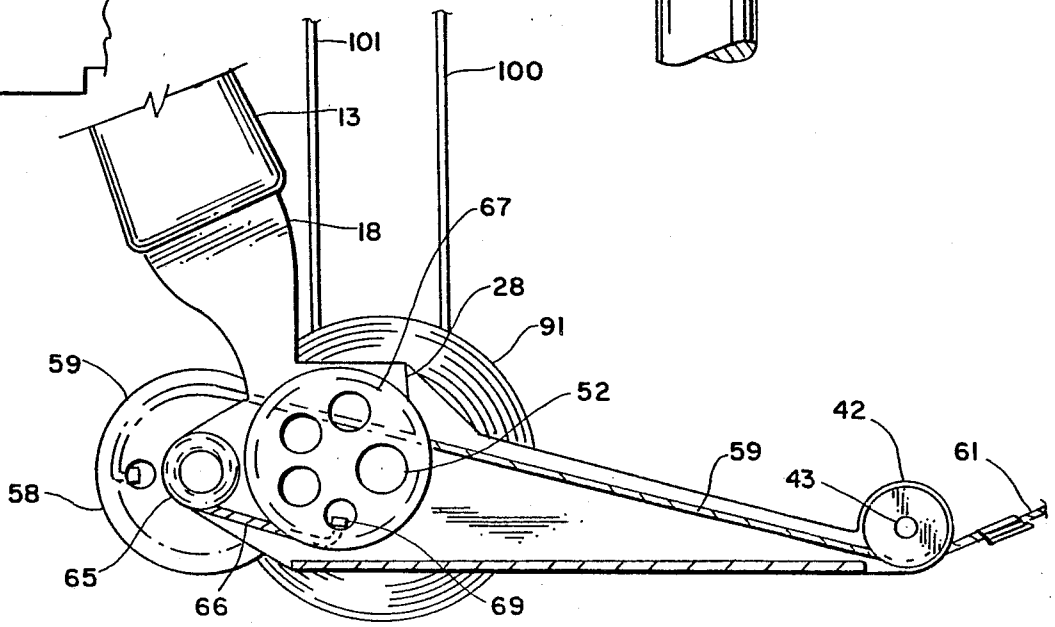
FIG. 4 is an enlarged fragmentary view of the lower arm portion of the bow of FIG. 1, with portions removed and in section, showing the bow in a fully drawn position.
Figure 5:
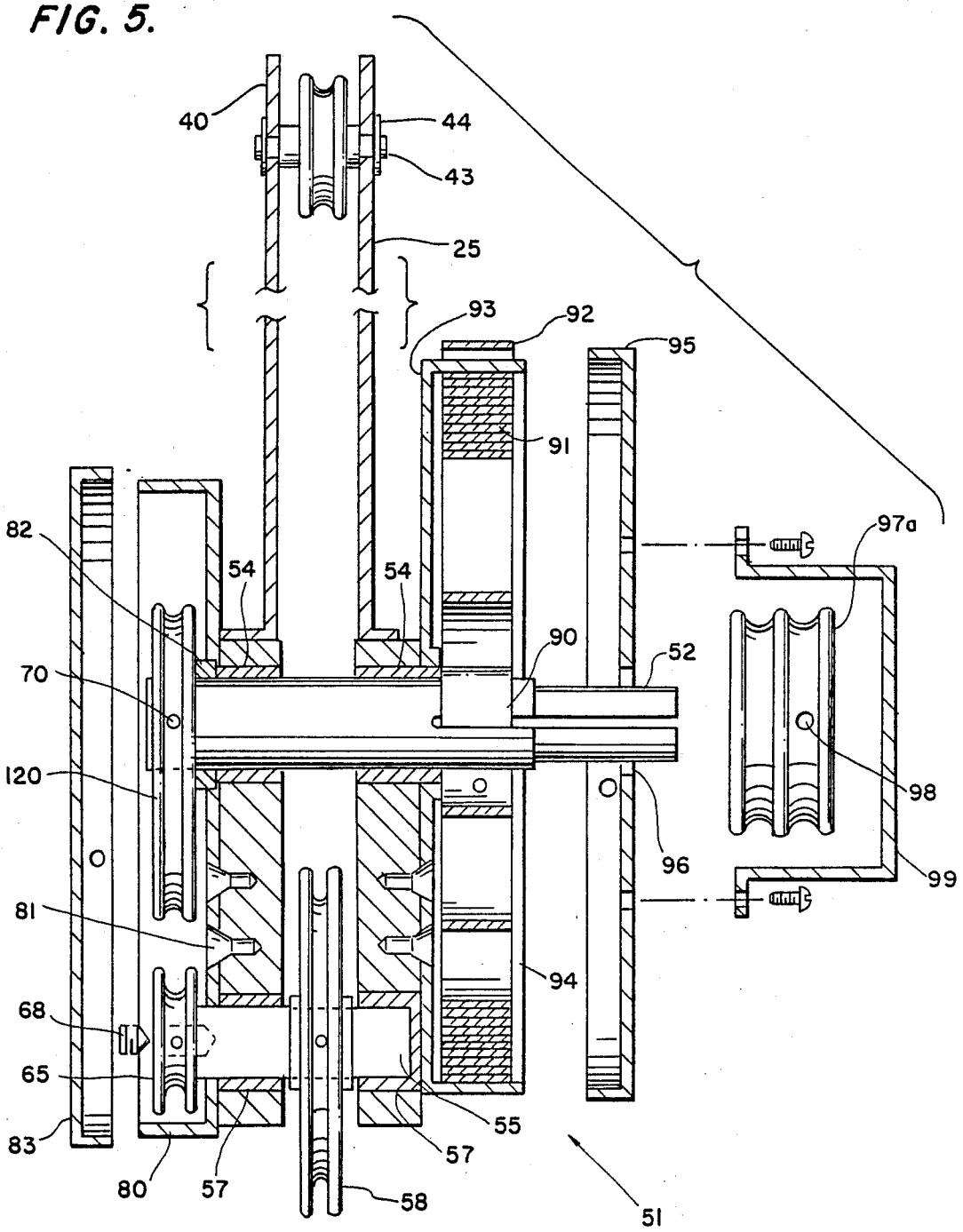
FIG. 5 is a greatly enlarged, fragmentary sectional view taken along line 5—5 in FIG. 1.
Figure 7:
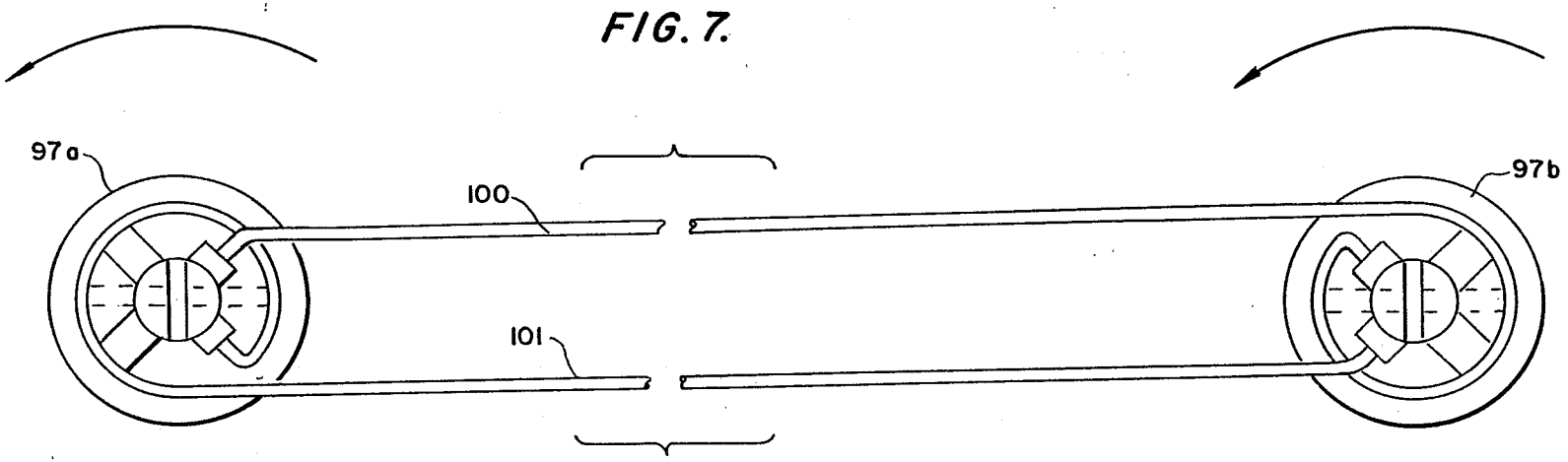
FIG. 7 is a fragmentary side view in elevation of the synchronizing wheels and cable assemblies of FIG. 6.

With particular reference to FIGS. 3, 5 and 8, an eccentric wheel housing 80 is secured to the side of the mounting block by means of suitable fasteners, such as screws 81 or the like. The ends of shafts 52 and 55 extend through aligned openings in the back wall of the housing, and the drive sprocket 65 and eccentric wheel 67 are secured on the ends of the respective shafts on the outside of the back wall of the housing. A spacer 82 is secured on the shaft 52 between the housing back wall and the eccentric wheel 67 to eliminate or reduce axial play in the shaft 52. A wheel housing cover plate 83 is secured over the wheel housing by means of screws 84 or other suitable fastener means to enclose the eccentric wheel, drive sprocket and torque cable.

The other end of shaft 52 is connected to the inner end 90 of a flat wound coil spring or power spring 91 positioned on the end of the shaft on the side of the bow opposite the eccentric wheel. The other or outer end 92 of the spring 91 is connected with spring housing 93, secured to the side of the mounting block 16 by means of screws or the like 94. Thus, the outer end of the coil spring 91 is fixed against movement, while the inner end is movable with rotation of the shaft 52 to wind up the spring and store energy when the bow string is drawn back. A spring housing cover 95 is secured over the outside of the housing 93 to confine the spring 91.

As seen best in FIG. 5, the end of shaft 52 projects through an opening 96 in the spring housing cover, and synchronizing pulley wheels 97*a* and 97*b* at opposite ends of the bow, respectively, are secured thereon with a pin 98. Cover 99 is secured on the outside of housing cover 95 to confine and protect the synchronizing wheels 97*a* and 97*b*.

A pair of synchronizing cables 100 and 101 are secured on the synchronizing pulley wheels and extend between the opposite ends of the bow (see FIGS. 2, 3, 6 and 7). These synchronizing cables and wheels constitute a direct drive between the recoil assemblies at opposite ends of the bow to cause them to operate at the same rate, thereby assuring smoothness of operation and cancelling any variation in rate between the two assemblies. In other words, the two recoil assemblies are effectively balanced by this mechanism. By referring to FIG. 7, it can be seen that as one cable 100 is winding up on a wheel 97*a*, the other cable 101 is unwinding from the wheel 97*a*, and vice versa. Thus, the direct drive synchronizing mechanism functions in both directions of operation, i.e., when the bow string is being drawn back and when the bow string is released to propel an arrow.

A nocking clip 105 is secured on the bow string in position to cooperate with an arrow nocked on the string, and an arrow rest 106 is secured to the side of the frame of the bow to support an arrow while it is being drawn back and released.

In operation, the recoil assemblies are initially set up with a pretension on the spring 91. When the bow string is drawn back, it pulls the cables 59 and rotates the drive pulleys or wheels 58, which in turn rotate the shafts 55 and drive sprockets 65. The torque cable 66, being connected to the drive sprocket, thus causes the eccentric wheel 67 to rotate, imparting rotation to the shaft 52 and winding up the spring 91. The synchronizing cables transmit the same motion to opposite ends of the bow, ensuring balanced operation. This action stores energy in the spring 91, which, when the bow string is released, quickly retracts the cables 59 and pulls the bow string forward to propel an arrow nocked therein.

The relationships of the diameters of the drive wheels 58, drive pulleys 65, shafts 52 and 55, and spring 91 all give rise to multiple mechanical advantages while the bow string is being drawn, requiring less force to draw back the bow string for a given power rating of the bow. Conversely, upon release of the bow string, the same mechanical advantages result in increased velocity of the movement of the bow string and thus an arrow propelled thereby.

Figure 12:
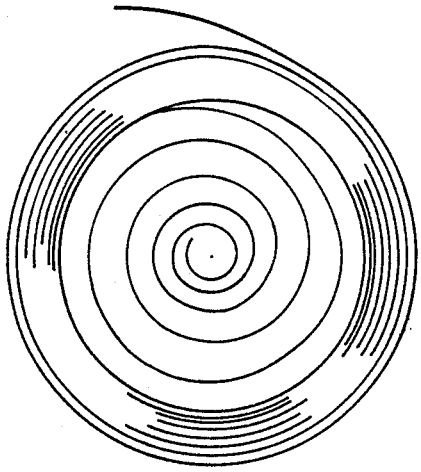
FIG. 12 is an enlarged schematic view of a flat wound power spring as used in the invention, depicting the distribution of mass in the spring.
Figure 15:
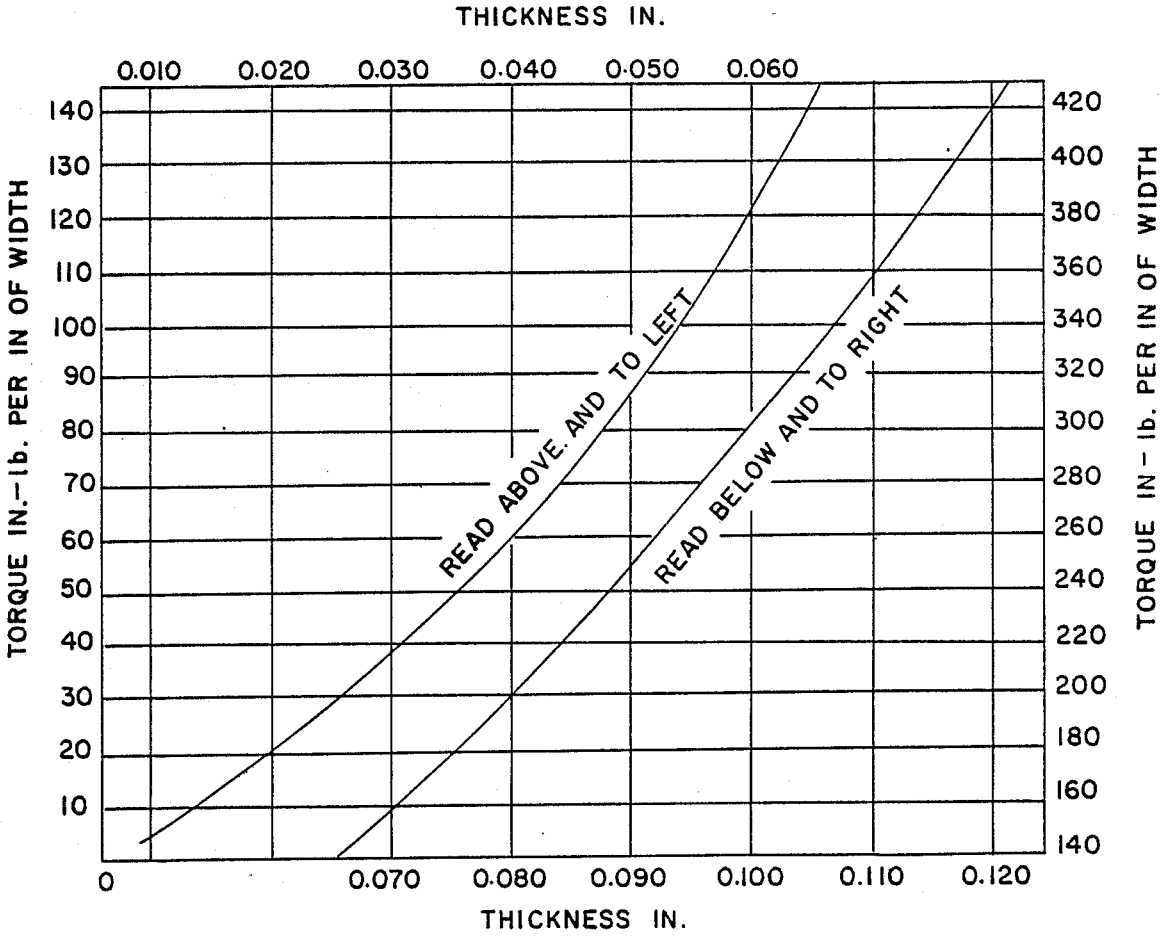
FIG. 15 is a graph of the maximum torque per square inch of spring width for a flat wound power spring.
Figure 13:
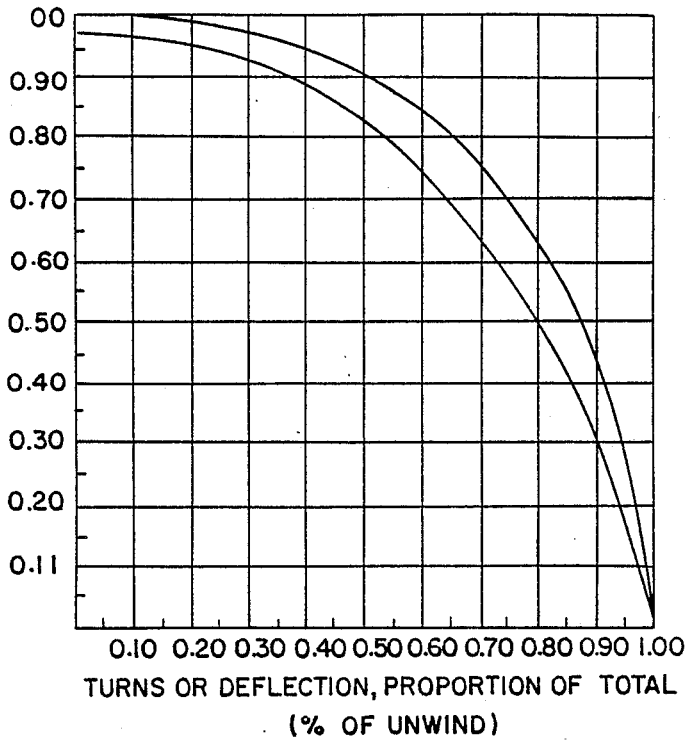
FIG. 13 is a graph of the torque-deflection curve for a flat wound power spring.
Figure 14:
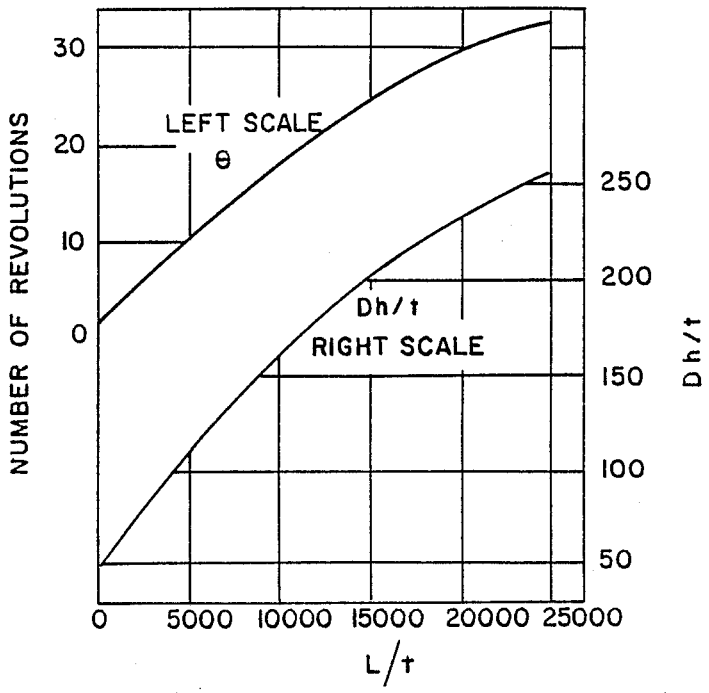
FIG. 14 is a graph of the relationship between the number of turns, the case diameter, the strip length and the thickness of flat wound power springs.

The flat wound coil springs, diameters of the various wheels and pulleys, and eccentricity of the eccentric wheel may all be selected to give a desired characteristic to the bow. In this regard, power springs or flat wound coil springs are of rectangular section material and are secured at their opposite ends. As the length to thickness ratio increases, the spiral space between coils increases rapidly. The spring is thus retained in a housing (93). Other than the transition coils and the coil which is attached to the arbor (52), the remaining coils are solidly against the housing (see FIG. 12). As the arbor rotates, solid material will become active as it pulls away from the case and is wound upon the arbor. The amount of active material is constantly changing, producing a non-linear force curve. See FIG. 13. Thus, by varying the parameters identified in FIGS. 13–15, the force characteristics of the spring can be varied.

A modification of the invention is shown at 10, in FIGS. 8–11. In this form of the invention, an eccentric cam 120 is used in place of the eccentric wheel 67 of the first-described form of the invention. With this design, transfer of leverage occurs completely at half draw and is utilized fully through the remaining half of the cycle. The eccentric wheel, on the other hand, transfers leverage smoothly across the full cycle of the wheel. This results in the full benefit of the mechanical advantage being present only at the very end of the cycle.

Figure 9:
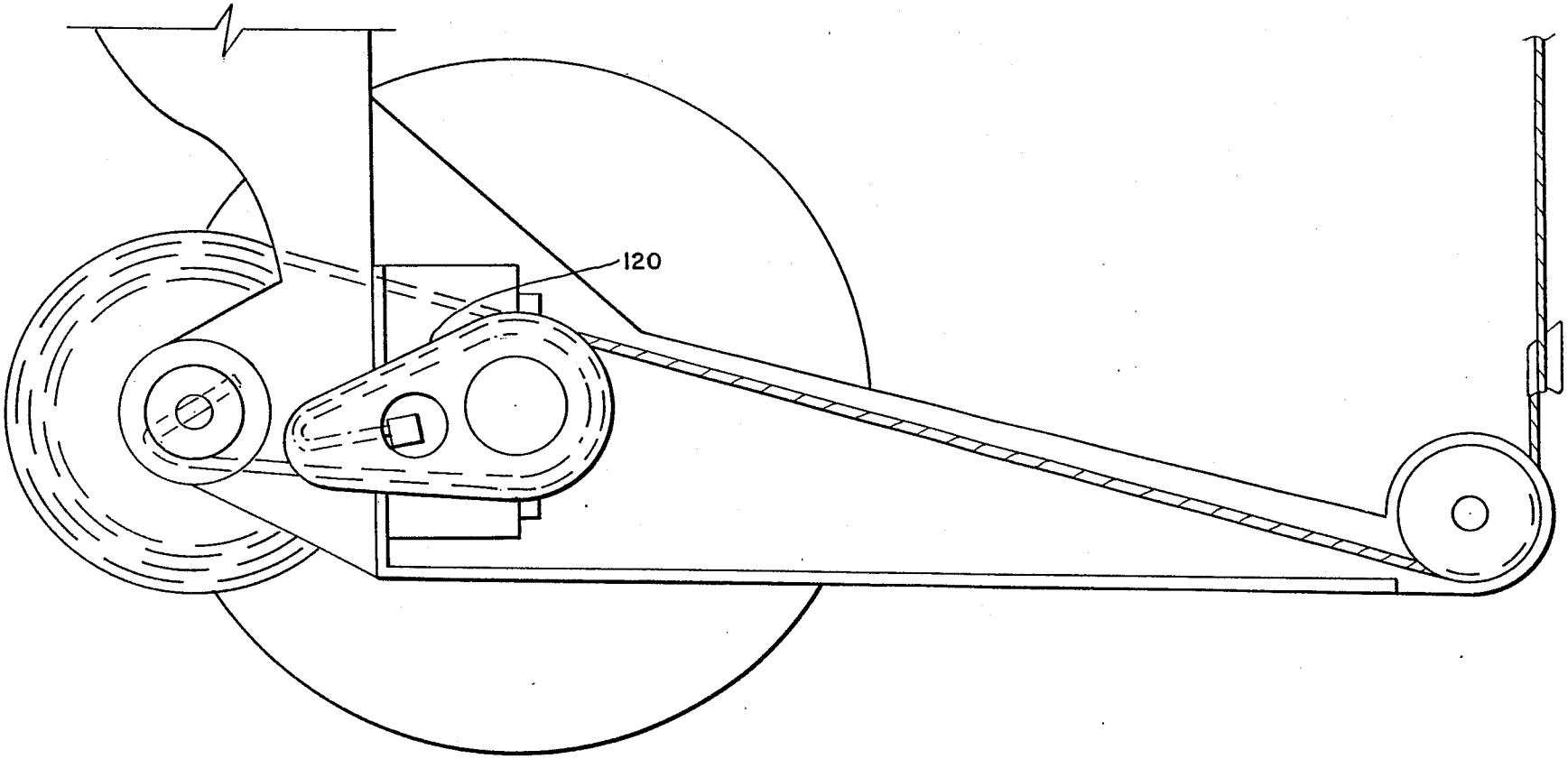
FIG. 9 is a fragmentary view in side elevation, with portions removed, showing the modified bow of FIG. 8 in an at-rest condition.

In FIG. 9 the bow is shown with the recoil assembly in an at-rest position, with the spring only under the tension of its preload.

Figure 10:
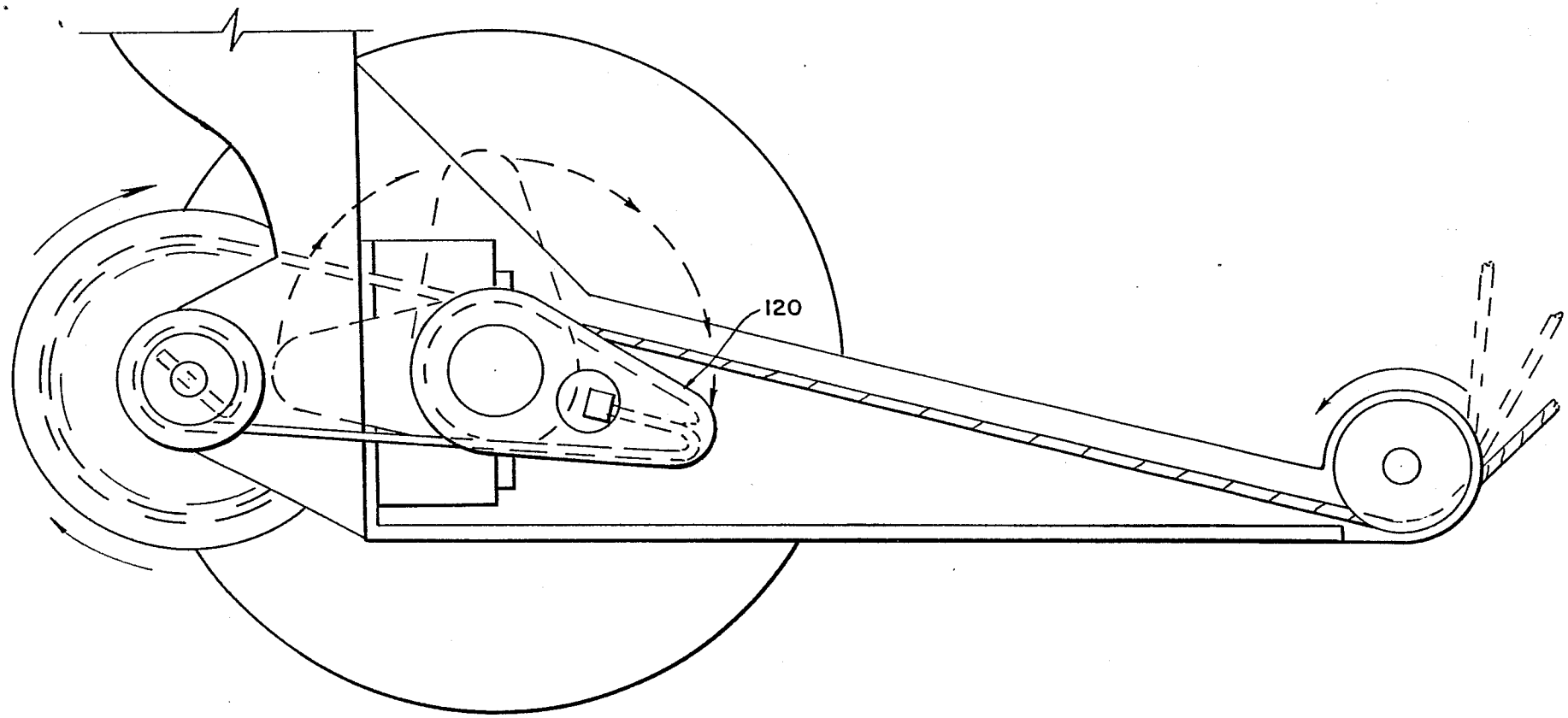
FIG. 10 is a view similar to FIG. 9, showing the bow in a partially drawn condition.

In FIG. 10, the bow is shown in a half drawn position. The cam/let-off mechanism is positioned to provide a longer lever, thus multiplying the mechanical advantage.

Figure 11:
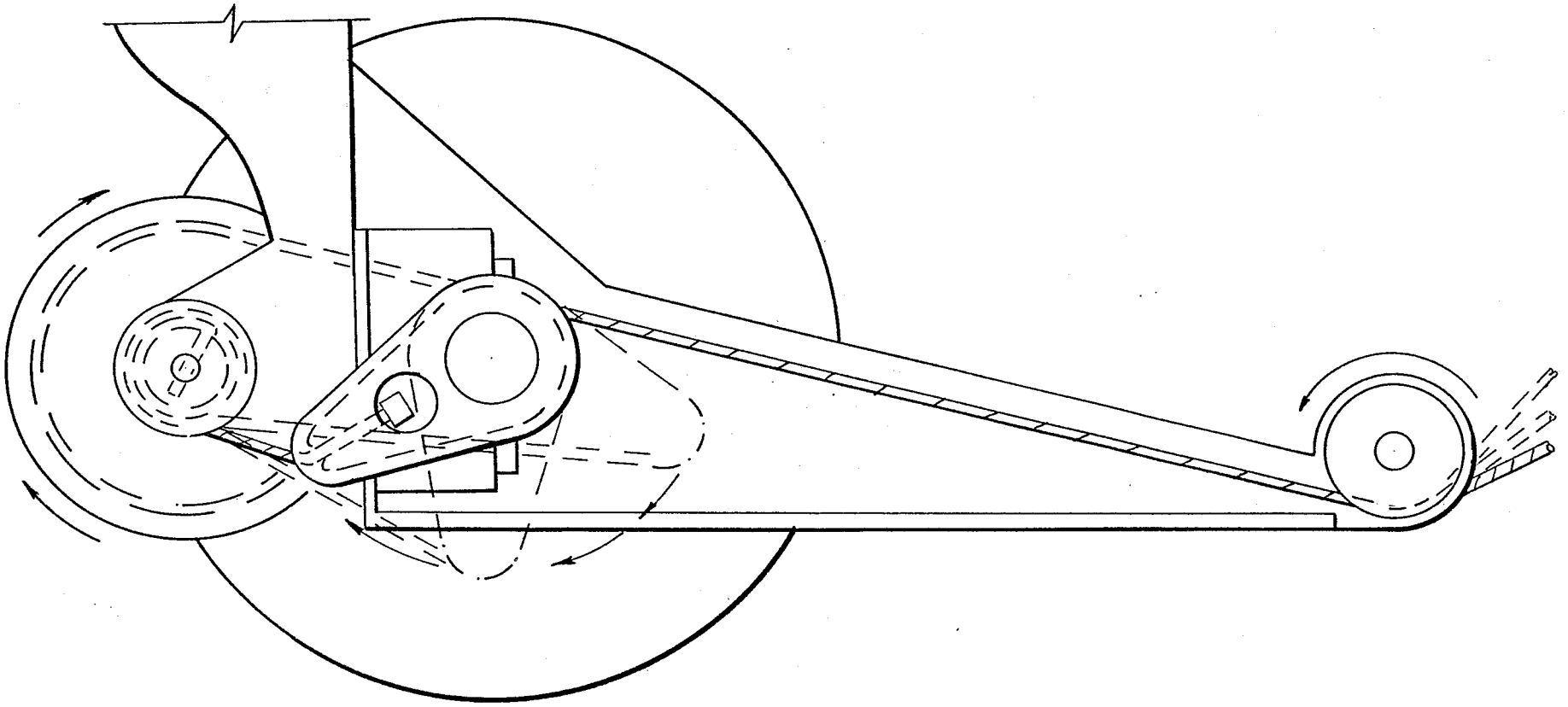
FIG. 11 is a view similar to FIG. 9, showing the bow in a fully drawn condition.

In FIG. 11, the cam is in its final stage of movement at the full drawn position.

In a specific example of the invention, the bow has an overall length of only about two feet, as compared with approximately four feet for a conventional compound bow. The springs 91 preferably comprise cold rolled carbon steel strip, ASTM 682, AISI 1074, and have a width of 0.50 inches, a thickness of 0.062 inches and a length of 156 inches. The housing 93 for containing the spring has a diameter of five inches, and the shaft or arbor 52 has a diameter of 0.625 inches. The spring is designed to deliver 49 inch-pounds of torque at two and one half revolutions (50% of the total available deflection and 82% of the total available torque). When the spring is installed, it is pre-loaded to 49 inch-pounds (wound to 2.5 revolutions). Thus, when the bow string is drawn back the spring is further wound, but the remaining available torque is only 18% of the total available of approximately 60 inch-pounds, i.e., only about 10.8 inch-pounds. Consequently, at the mid-point of the draw, where the "let-off" becomes effective, the spring has developed approximately 54 inch-pounds of torque. It should be noted that during operation from an at-rest position to a full draw position, the spring only makes one revolution.

The let-off action of the bow of the invention, as achieved through the mechanical advantages gained through the use of larger and smaller diameter drive and driven wheels and shafts, and the use of an eccentric cam or wheel, reduces the force required by one-half. Therefore, at mid-draw, the required force to draw the string drops from approximately 54 inch-pounds to approximately 27 inch-pounds and increases to only about 30 inch-pounds at full draw. The effect is reversed when the string is released, and the dramatic increase in torque at approximately the mid-point is transmitted to the arrow.

Although two spring assemblies are used, each developing the same torque, the effectiveness of each spring is reduced by half because of the relationships between the cable supply wheel or drive wheel 58 and the drive sprocket 65. Thus, to realize 54 inch-pounds of torque at half draw, two spring assemblies each developing that amount of torque are required.

The performance of the springs may be altered by changing the preloaded torque. For instance, the springs could be wound only one revolution as installed, instead of two and one-half revolutions. In this case, the springs would be preloaded to 30 inch-pounds (50% of the available torque). An additional 15 inch-pounds would be available in the additional one revolution required, and approximately eight of those inch-pounds would be realized at mid-draw. Thus, at mid-draw, the required force to draw the string would drop from 38 inch-pounds to 19 inch-pounds. The recoil performance would be similarly effected.

The frame and arms, pulleys, wheels and housings could be made of any suitable material, including reinforced glass fiber, metal (aluminum, etc.), wood and the like.

The unique bow of the invention is made possible by using in combination the flat wound coil spring and fixed arms, with mechanical advantages obtained through the use of different diameter wheels and cam levers.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. An archery bow, comprising:

a frame member having means defining a hand grip;

an arm on each end of the frame member and extending outwardly therefrom to a free end;

at least one recoil assembly mounted to said frame member, said recoil assembly including flat wound coil spring means; and a bow string extended between said arm free ends and having its ends connected to said flat wound coil spring means, whereby movement of said bow string from an at-rest position to a drawn position causes said spring to wind up, storing energy therein so that release of said bow string results in release of the stored energy in the coil spring to the string to return it to its initial position and thus propel an arrow nocked therein.

2. An archery bow as claimed in claim 1, wherein:
said arms comprise separate members fixed on the ends of said frame member.

3. An archery bow as claimed in claim 2, wherein:
said arms are rigid.

4. An archery bow as claimed in claim 1, wherein:
a recoil assembly is mounted to each end of said frame member, each recoil assembly including a flat wound coil spring means having one end thereof connected to said frame member and the other end connected to a respective end of said bow string, whereby movement of the bow string from its at-rest position to a drawn position causes both of said flat wound coil springs to wind up and store energy.

5. An archery bow as claimed in claim 4, wherein:
synchronization means is connected between the recoil assemblies at opposite ends of the frame member for synchronizing the action of the recoil assemblies.

6. An archery bow as claimed in claim 4, wherein:
an idler pulley is supported on each arm free end, said bow string being disposed about and supported on said idler pulleys.

7. An archery bow as claimed in claim 6, wherein:
each recoil assembly includes mechanical advantage means connected between the respective end of the bow string and the respective flat wound coil spring, whereby the force required to move the bow string from its at-rest position to its drawn position is less than the poundage rating of the bow.

8. An archery bow as claimed in claim 7, wherein:
there are multiple mechanical advantage means associated with each recoil assembly, including let-off means for reducing the force required to move the string during its movement between its at-rest position and its fully drawn position.

9. An archery bow as claimed in claim 6, wherein:
the mechanical advantage means comprises a series of large and small diameter wheels, shafts and pulleys arranged so that a mechanical advantage is obtained when the string is drawn.

10. An archery bow as claimed in claim 7, wherein:
the mechanical advantage means further comprises an eccentric connected in series with the large and small diameter wheels, shafts and pulleys, said eccentric acting to change its force lever arm during movement between the at-rest position of the string and the fully drawn position of the string and thereby effecting a reduction in the force necessary to move the string.

11. An archery bow as claimed in claim 10, wherein:
synchronization means is connected between the recoil assemblies at opposite ends of the frame member for synchronizing the action of the recoil assemblies.

12. An archery bow as claimed in claim 11, wherein:
the synchronization means comprises a double pulley wheel connected to rotate with said eccentric, and a pair of cables extending between the double pulley wheels at opposite ends of the bow and connected so that one cable is wound up as the other is unwound.

13. An archery bow as claimed in claim 12, wherein:
the frame member has bifurcated ends defining a pair of spaced apart mounting blocks, said recoil assemblies being mounted to said mounting blocks.

14. An archery bow as claimed in claim 13, wherein:
the recoil assemblies each include a drive wheel rotatably supported in the bifurcated ends between the mounting blocks; and
a cable connects the respective ends of the bow string with a respective drive wheel, said cable being wound up on said drive wheel and held in tension by said flat wound coil spring, said spring being connected at one end for rotation with said wheel.

15. An archery bow as claimed in claim 14, wherein:
a drive shaft is rotatably supported in said mounting blocks at each end of the bow;
a driven shaft is rotatably supported in said mounting blocks at each end of the bow in parallel, spaced relationship to the drive shaft; and
said drive wheel is fixed on said drive shaft, and said flat wound coil spring and said eccentric are fixed on said driven shaft.

16. An archery bow as claimed in claim 15, wherein:
a drive pulley is fixed on said drive shaft, said eccentric is coplanar with said drive pulley, and a torque cable is connected between said drive pulley and said eccentric to impart rotational movement from one to the other.

17. An archery bow, comprising:
a frame member having means defining a hand grip;
a fixed arm secured on each end of the frame member and extending outwardly therefrom to a free end;
flat wound coil spring means mounted to said frame member;
a bow string extended between said arm free ends and having its ends connected to said flat wound coil spring means, whereby movement of said bow string from an at-rest position to a drawn position causes said spring to wind up, storing energy therein so that release of said bow string results in release of the stored energy in the coil spring to the string to return it to its initial position and thus propel an arrow nocked therein; and
multiple mechanical advantage means connected between said bow string and said flat wound coil spring for reducing the force required to move the string to its drawn position against the resistance of the spring.

18. An archery bow, comprising:
a frame member having means thereon defining a hand grip;
an arm projecting outwardly from opposite ends of said frame member and terminating in outer free ends;
spring means carried by said frame member;
a bow string extending between said arm free ends and having an initial, at rest position and a fully drawn position, said bow string being connected to said spring means so that when the string is moved from its at rest position towards its fully drawn position it causes energy to be stored in said spring means, and release of said bow string results in the stored energy in the spring means being positioned and propelling an arrow nocked therein; and mechanical advantage means connected between said bow string and said spring means for reducing the force required to move the string to its fully drawn position against the resistance of the spring means, said mechanical advantage means serving to accelerate the movement of the string from its fully drawn position to its at-rest position when it is released, and said mechanical advantage means including a cam member connected with said spring means to be rotated thereby, said cam member comprising a let off means which reduces the force during movement of the string between its at-rest position and its fully drawn position, a drive sprocket connected to the cam member to be rotated with the cam member and a storage spool connected to the drive sprocket to be rotated with said drive sprocket for winding up and storing string when the bow is in its at-rest position, whereby the amount of draw of the bow string is affected by the amount of string wound up on the storage spool and the force required to fully draw the bow string is a function of the spring means, the cam member design and the relative dimension of the drive sprocket and the storage spool.

19. An archery bow as claimed in claim 3, wherein:

a cable is connected at one end to the bow string and at its other end to the take-up spool, said cable being wound up on the take-up spool when the bow is in its at-rest position.

20. An archery bow as claimed in claim 19, wherein:

said mechanical advantage means includes a recoil assembly at the juncture of each arm with the frame member, each of said recoil assemblies including a said spring means and a said take-up spool, and an eccentric cam connected with the respective spring means, a second cable connected at one end with the respective cam and connected at its other end with a drive sprocket, said drive sprocket being connected for rotation with said take-up spool, and a synchronizing cable connected at its opposite ends of the frame member for causing the recoil assemblies to operate at the same rate.

* * * * *